United States Patent [19]

Voorhis

[11] 4,394,816

[45] Jul. 26, 1983

[54] HEAT PUMP SYSTEM

[75] Inventor: Roger J. Voorhis, Liverpool, N.Y.

[73] Assignee: Carrier Corporation, Syracuse, N.Y.

[21] Appl. No.: 317,093

[22] Filed: Nov. 2, 1981

[51] Int. Cl.[3] ..... F25B 41/06

[52] U.S. Cl. ..... 62/205; 62/223; 62/324.6; 137/625.3

[58] Field of Search ..... 62/222, 223, 205, 211, 62/528, 527, 511, 160, 324.6, 224, 196 A, 196 C, 197, 228 C; 137/599, 599.1, 601, 625.3, 625.28, 625.38

[56] References Cited

U.S. PATENT DOCUMENTS

| | | | |
|---|---|---|---|
| 2,322,658 | 6/1943 | Overbeke | 137/166 |
| 2,914,925 | 12/1959 | Martin | 62/511 X |
| 3,327,760 | 6/1967 | Crawford, Jr. | 137/599 X |
| 3,677,028 | 7/1972 | Raymond | 62/200 |
| 3,992,898 | 11/1976 | Duell et al. | 62/527 |
| 4,268,291 | 5/1981 | Cann | 62/224 |

*Primary Examiner*—Albert J. Makay
*Assistant Examiner*—Harry Tanner
*Attorney, Agent, or Firm*—Donald F. Daley; David L. Adour

[57] ABSTRACT

A heat pump system comprising a compressor, two heat exchangers, and an expansion device. The expansion device defines two, spaced apart flow passages. A first piston is located in a first flow passage for metering refrigerant flow therethrough at a first flow rate, and a second piston is located in the second flow passage for metering refrigerant flow therethrough at a second flow rate less than the first flow rate. The expansion device includes a valve having a first position, closing the second flow passage to direct refrigerant through the first flow passage, and a second position, closing the first flow passage to direct refrigerant through the second flow passage.

9 Claims, 2 Drawing Figures

HEAT PUMP SYSTEM

BACKGROUND OF THE INVENTION

Figure 1:
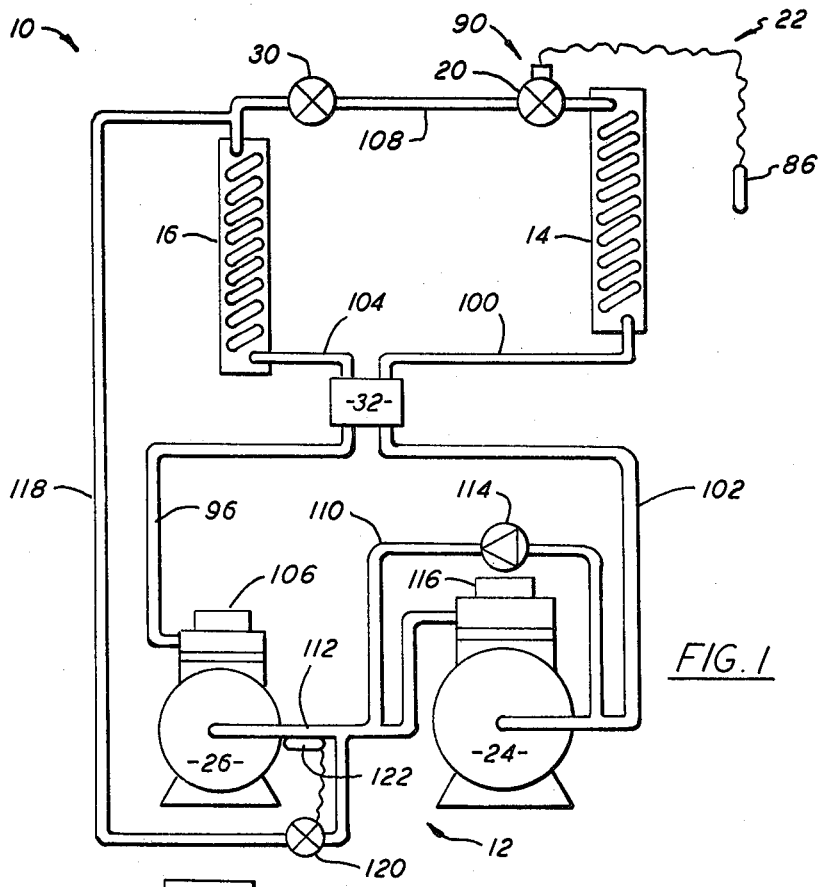

This invention generally relates to heat pump systems, and specifically to heat pump systems designed for use in cooler climates.

In a typical vapor compression refrigeration circuit, various components, including a compressor, two heat exchangers, and an expansion device, are arranged and operated to transfer heat from one location to another. For example, heat may be transferred from a room within a building to the outdoors, cooling the room. With a heat pump system, a reversing valve is provided to reverse refrigerant flow through portions of the system so that the system may transfer heat not only from a first location to a second, but also from the second location to the first. For example, a first heat exchanger may be located within an enclosure and a second heat exchanger may be located outside the enclosure. In a cooling mode, heat is transferred from the first heat exchanger to the second, cooling the enclosure. In a heating mode, heat is transferred from the second heat exchanger to the first, heating the enclosure.

Heat pump systems operate very effectively, efficiently, and economically under many conditions and, not surprisingly, have found considerable acceptance. However, in cooler climates, for example in the northern regions of the United States, heat pump systems have heretofore not met with much commercial success. A major reason for this is because the heating load requirements in rooms or buildings in these areas vary widely, and difficulties have been encountered in providing an economically practical heat pump system which will effectively satisfy widely varying heating load requirements.

To elaborate, typically, a heat pump system is sized to satisfy efficiently the usual or normal expected loads on the system. In an environment having widely varying heating load requirements, the maximum capacity of such a typical heat pump system may not be large enough to satisfy the maximum expected heating load thereon. The capacity of the heat pump system can be increased, of course, but doing this usually increases the cost of the system and may reduce the operating efficiency thereof. Thus, in areas having widely varying heating load requirements, the user is often faced with a difficult dilemma: either employ a smaller, more economical heat pump system, even though that heat pump system, by itself, will not satisfy the maximum expected heating load thereon, or use a larger, more expensive heat pump system which will effectively satisfy the maximum expected heating load on the system, even though this particular heat pump system may be so expensive as to be economically impractical.

SUMMARY OF THE INVENTION

An object of this invention is to provide an economical heat pump system that will efficiently meet small or modest loads and that will effectively meet large heating loads.

Another object of the present invention is to provide a heat pump system with an expansion device having two, separate and parallel stages to vary the refrigerant flow rate through the expansion device.

A further object of this invention is to provide a very simple and inexpensive expansion device having discretely variable fluid flow rates.

These and other objects are attained with a heat pump system comprising compressor means for compressing refrigerant vapor, a first heat exchanger for condensing refrigerant vapor from the compressor means, a second heat exchanger for evaporating condensed refrigerant from the first heat exchanger, and an expansion device located between the first and second heat exchangers for expanding condensed refrigerant passing from the first heat exchanger to the second heat exchanger. The expansion device includes a body, first restriction means, second restriction means, and a valve. The body defines an inlet, an outlet, a first flow passage for conducting refrigerant from the inlet to the outlet, and a second flow passage spaced from the first flow passage and also for conducting refrigerant from the inlet to the outlet.

The first restriction means is located in the first flow passage and defines first port means for metering refrigerant flow through the first flow passage at a first flow rate, and the second restriction means is located in the second flow passage and defines second port means for metering refrigerant flow through the second flow passage at a second flow rate less than the first flow rate. The valve is supported within the body for movement between a first position and a second position. In the first position, the valve closes the second flow passage to direct refrigerant through the first flow passage; and in the second position, the valve closes the first flow passage to direct refrigerant through the second flow passage. The heat pump system further includes a control for moving the valve between the first and second positions.

A BRIEF DESCRIPTION OF THE DRAWING

Figure 2:
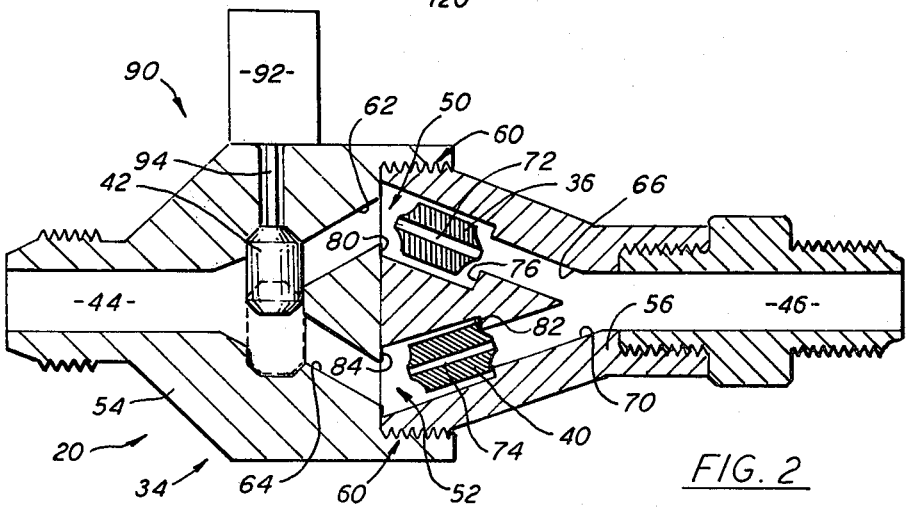

FIG. 1 is a schematic view of a heat pump system in accordance with the present invention; and FIG. 2 is a side view, partially in cross section, of the two stage expansion device of the heat pump system shown in FIG. 1.

A DETAILED DESCRIPTION OF THE PREFERRED EMBODIMENT

While the preferred embodiment of the present invention is employed as a reversible refrigeration circuit, commonly referred to as a heat pump system, it should be understood that the present invention is applicable to refrigeration circuits generally. Thus, the present invention may be employed solely for heating or cooling, as well as for both heating and cooling. Furthermore, although the disclosed heat pump system described in detail below includes two compressors, it should be made clear that the present invention may be employed with one, two, or more than two compressors.

Referring now to the drawing, FIG. 1 is a schematic illustration of heat pump system 10 in accordance with the present invention. Generally, system 10 includes compressor means 12, heat exchangers 14 and 16, expansion device 20, and expansion device control 22. Preferably, compressor means 12 includes first or low stage compressor 24 and second or high stage compressor 26; and since system 10 preferably transfers heat in either direction between heat exchangers 14 and 16, the system further includes second expansion device 30 and reversing valve 32.

Heat exchangers 14 and 16, compressors 24 and 26, expansion device 30, and reversing valve 32 may all be of a conventional nature. Preferably, of course, each heat exchanger 14 and 16 effectively acts as either a condenser or an evaporator.

In addition, second expansion device 30 preferably serves to meter refrigerant flow in one direction, specifically when the refrigerant flows through the second expansion device from right to left as viewed in FIG. 1, and allows a substantially free flow of refrigerant in the opposite direction.

Discussing first expansion device 20 in greater detail, this expansion device is located between heat exchangers 16 and 14 for expanding condensed refrigerant passing from the former to the latter; and, particularly referring to FIG. 2, expansion device 20 includes body 34, first restriction means 36, second restriction means 40, and valve 42. Body 34 defines inlet 44, outlet 46, and first and second flow passages 50 and 52. First flow passage 50 is provided for conducting refrigerant from inlet 44 to outlet 46, and second flow passage 52 is spaced from the first flow passage and is also provided for conducting refrigerant from inlet 44 to outlet 46. It should be noted that preferably fluid may flow through body 34 in either direction, from inlet 44 to outlet 46 or from the outlet to the inlet, depending on the particular mode of operation of heat pump system 10.

Also, preferably body 34 includes first section 54, second section 56, and connecting means 60. First section 54 defines inlet 44, first portion 62 of flow passage 50, and first portion 64 of second flow passage 52. Second section 56 defines outlet 46, second portion 66 of first flow passage 50, and second portion 70 of second flow passage 52. Connecting means 60 releasably connects together first and second sections 54 and 56 of body 34, and preferably the connecting means includes a plurality of internal threads defined by a first end of first body section 54 and a plurality of complementary, external threads defined by a first end of second body section 56.

First restriction means 36 is located in first flow passage 50 and defines first port means 72 for metering refrigerant fluid flow through the first flow passage at a first flow rate. Second restriction means 40 is located in second flow passage 52 and defines second port means 74 for metering refrigerant fluid flow through the second flow passage at a second flow rate less than the first flow rate.

Preferably, first restriction means 36 includes a first piston supported by second section 56 of body 34 for sliding movement within second portion 66 of first flow passage 52, and first port means 72 comprises a central opening extending through the first piston. Similarly, second restriction means 40 preferably includes a second piston supported by second section 56 of body 34 for sliding movement within second portion 70 of second flow passage 54, and second port means 74 comprises a central opening extending through the second piston. The cross-sectional area of opening 72 transverse to the direction of the refrigerant flow therethrough is larger than the corresponding cross-sectional area of opening 74 so that, under similar circumstances, the former opening will conduct refrigerant at a greater flow rate than will the latter opening.

With this piston type restriction means, preferably body 34 further includes means, for example shoulders 76 and 80, maintaining first piston 36 within second portion 66 of first flow passage 50; and means, for example shoulders 82 and 84, maintaining second piston 40 within second portion 70 of second flow passage 52. Shoulders 76 and 82 also provide seats against which pistons 36 and 40 fit when the refrigerant flow through the pistons is from inlet 44 to outlet 46, assisting to direct that refrigerant flow through metering ports 72 or 74. Preferably, though, restriction means 36 and 40 allow a substantially free flow through flow passages 50 and 52 when the flow therethrough is from outlet 46 to inlet 44, from right to left as viewed in FIGS. 1 and 2. However, it should be noted that with the embodiment of body 34 illustrated in the drawing, disassembly of body sections 54 and 56 exposes flow passages 50 and 52 to provide access to pistons 36 and 40.

Valve 42 is supported within body 34 from movement between a first position, shown in broken lines in FIG. 2, and a second position, shown in full lines in FIG. 2. In the first position, valve 42 closes second flow passage 52 to direct refrigerant through first flow passage 50; and in the second position, the valve closes the first flow passage to direct refrigerant through the second flow passage. Preferably, valve 42 linearly moves between its first and second positions, and preferably the valve is located in inlet 44 and, as the valve moves between its first and second positions, the valve moves generally transverse to the direction of the fluid flow through the inlet.

Control 22 is provided for moving valve 42 between the first and second positions, and preferably this control includes sensor 86 and motive means 90. Sensor 86 senses a control temperature, and motive means 90 is responsive to the sensor for moving valve 42 from the first position to the second position when the control temperature falls below a preset level and for moving the valve from the second position back to the first position when the control temperature rises above the preset level. As will be understood by those skilled in the art, any suitable temperature may be used to control valve 42. For example, if heat pump system 10 is employed to transfer heat from the outdoors to inside an enclosure, the control temperature may be the outdoor air temperature.

Any suitable sensor 86 and motive means 90 may be employed in the practice of the present invention. With the preferred embodiment of the invention, motive means 90 comprises a conventional actuating device such as a two position electric solenoid 92 secured to body 34 and mechanically connected to valve 42 via stem 94, and sensor 86 comprises a simple bi-metallic switch located in heat transfer relation with the outdoor air and arranged to connect and disconnect solenoid 92 from and to an electric energy source as the outdoor air temperature, respectively, falls below and rises above the preset level.

OPERATION

To condition an enclosure or area, of course, a first heat exchanger, for example heat exchanger 14, is placed outside the enclosure, and a second heat exchanger, for example heat exchanger 16, is located within the enclosure.

To cool the enclosure, reversing valve 32 is placed in a first position communicating high pressure discharge line 96 of second stage compressor 26 with line 100, which directly connects the reversing valve with outdoor heat exchanger 14, and communicating low pressure return line 102 with line 104, which directly connects the reversing valve with indoor heat exchanger 16. Compressor 26 is activated by control means 106, and the second stage compressor discharges hot, compressed refrigerant vapor into discharge line 96. The vapor is conducted through line 96, reversing valve 32, and line 100, and into outside heat exchanger 14. The vapor passes through heat exchanger 14, rejecting heat to a cooling medium such as air passing over the heat exchanger. As refrigerant vapor rejects heat, the vapor condenses, and liquid refrigerant is discharged from heat exchanger 14 into interconnecting line 108.

Refrigerant flows through line 108 and through expansion devices 20 and 30. The refrigerant expands as it passes through the latter expansion device, reducing the temperature and pressure of the refrigerant. The expanded refrigerant is conducted through indoor heat exchanger 16, where the refrigerant absorbs heat from an external heat exchange medium such as indoor air passing over heat exchanger 16. As refrigerant passes through heat exchanger 16, refrigerant fluid vaporizes, and refrigerant vapor is discharged from heat exchanger 16 into line 104. The vapor is conducted through line 104, through reversing valve 32, and into low pressure return line 102.

Typically, low stage compressor 24 is not needed to satisfy the cooling load on heat pump system 10, and the low stage compressor is left inactive when the heat pump system is in the cooling mode. Bypass line 110 is provided for conducting refrigerant vapor around low stage compressor 24; and when the low stage compressor is inactive, vapor from return line 102 cannot flow through the low stage compressor and instead passes into the bypass line. The vapor flows through bypass line 110 and through interstage line 112, which conducts the vapor back to high stage compressor 26, completing the circuit.

To heat the enclosure, reversing valve 32 is moved to a second position, communicating discharge line 96 with line 104 and low pressure line 102 with line 100. Now, hot, compressed refrigerant vapor discharged from compressor 26 is conducted through lines 96 and 104 and into indoor heat exchanger 16. Heat exchanger 16 acts as a condenser; and vapor passes therethrough, rejects heat to the space being heated, and condenses. Condensed refrigerant is discharged from heat exchanger 16 and is conducted through line 108 and through expansion devices 20 and 30. Under normal operating conditions, valve 42 of expansion device 20 is in the first position, directing refrigerant through first flow passage 50 and first restriction means 36. The refrigerant expands as it passes through restriction means 36, reducing the temperature and pressure of the refrigerant. The expanded refrigerant is conducted through outdoor heat exchanger 14, which now acts as an evaporator. As refrigerant fluid passes through heat exchanger 14, the refrigerant absorbs heat from the ambient and evaporates. The evaporated refrigerant is discharged into line 100; and the refrigerant is conducted therethrough, through valve 32, and into low pressure line 102.

If low stage compressor 24 is not needed to satisfy the heating load on heat pump system 10, the low stage compressor is left inactive. Again, vapor cannot pass through low stage compressor 24, and vapor passes from low pressure line 102 into bypass line 110. The vapor passes through line 110, through interstage line 112, and into high stage compressor 26, completing the circuit. As the outdoor temperature falls, the heating load on system 10 increases; and, typically, when the outdoor temperature falls below a certain level, low stage compressor 24 is activated by control means 116. Compressor 24 draws vapor from low pressure line 102, compresses this vapor, and discharges the vapor into interstage line 112. Vapor is conducted through line 112 and into high stage compressor 26. Check valve 114, it should be noted, is located in bypass line 110 to prevent reverse vapor flow therethrough.

If the outdoor temperature continues to fall, the heating load on heat pump system 10 increases and, at the same time, the capacity of the heat pump system decreases. If the outdoor temperature falls below a preset level, control 22 moves valve 42 of expansion device 20 to the second position. Valve 42 now closes first passage 50 and directs refrigerant through second flow passage 52 and through second metering port 74. Port 74 meters refrigerant flow from inlet 44 to outlet 46 at a slower rate than does port 72 of first restriction means 36. Hence, moving valve 42 from the first position to the second position lowers the refrigerant flow rate through expansion device 20, and this increases the amount of liquid refrigerant accumulating in interconnecting line 108 and in indoor, condensing heat exchanger 16. Increasing the mass of condensed refrigerant in heat exchanger 16 increases the quantity of heat transferred from the warmer, condensed refrigerant to the cooler ambient, thus increasing the capacity of heat pump system 10.

Preferably, it should be pointed heat pump system 10 includes quench line 118, quench valve 120, and sensor 122. Quench line 118 is provided for conducting cool, liquid refrigerant to interstage line 112 to prevent the refrigerant vapor entering high stage compressor 26 from reaching excessive temperature levels. Quench valve 120 is located in quench line 118 to control refrigerant flow therethrough; and the quench valve, in turn, is controlled by sensor 122, which preferably senses the temperature of refrigerant entering high stage compressor 24.

As may be understood from a review of the above discussion, heat pump system 10 of the present invention may be used to satisfy small or moderate loads efficiently and economically, while still having the capacity to meet large loads. More particularly, the parameters of heat pump system 10, including the size of first metering port 72, may be designed for small or moderate loads, resulting in a heat pump system which has a modest cost and which, when refrigerant is directed through first flow passage 50 and through the first metering port, very efficiently satisfies the average or typical loads on the heat pump system. If, though, with these parameters, system 10 is unable to operate effectively at very low, atypical outdoor temperatures, refrigerant flow through expansion device 20 can be directed through second flow passage 52 when these atypical temperatures are present, providing increased capacity. When outdoor temperatures return to more normal values, refrigerant flow can be switched back through first flow passage 50, returning the operating parameters of system 10 to those which more efficiently handle the normal loads on the heat pump system. Furthermore, the specific mechanism for providing this flexibility, expansion device 20 and control 22, involves relatively few, simple parts. Consequently, expansion device 20 and control 22 are very effective and reliable, yet the expansion device and control are simple and inexpensive, requiring minimal skill to assemble, install, and maintain.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A heat pump system comprising:

compressor means for compressing refrigerant vapor;

a first heat exchanger located within an enclosure for condensing refrigerant vapor from the compressor means;

a second heat exchanger located outside the enclosure in heat exchange relationship with a heat exchange medium located ouside the enclosure, for evaporating condensed refrigerant from the first heat exchanger;

an expansion device located between the first and second heat exchangers for expanding condensed refrigerant passing from the first heat exchanger to the second heat exchanger, and including a body defining an inlet, an outlet, a first flow passage for conducting refrigerant from the inlet to the outlet, and a second flow passage spaced from the first flow passage and also for conducting refrigerant from the inlet to the outlet, first restriction means located in the first flow passage and defining first port means for metering refrigerant flow through the first flow passage at a first flow rate, second restriction means located in the second flow passage and defining second port means for metering refrigerant flow through the second flow passage at a second flow rate less than the first flow rate, and a valve supported within the body for movement between a first position, closing the second flow passage to direct refrigerant through the first flow passage, and a second position, closing the first flow passage to direct refrigerant through the second flow passage;

a sensor for sensing the temperature of the medium outside the enclosure which is in heat exchange relationship with the second heat exchanger; and means responsive to the sensor for moving the valve from the first position to the second position when the sensed temperature falls below a preset level.

2. A heat pump system as defined by claim 1 wherein the body includes:

a first section defining the inlet, a first portion of the first flow passage, and a first portion of the second flow passage;

a second section defining the outlet, a second portion of the first flow passsage, and a second portion of the second flow passage; and means releasably connecting together the first and second sections.

3. A heat pump system as defined by claim 2 wherein:

the first restriction means includes a first piston supported by the second section of the body for sliding movement within the second portion of the first flow passage;

the second restriction means includes a second piston supported by the second section of the body for sliding movement within the second portion for the second flow passage; and the body further includes means maintaining the first piston within the second portion of the first flow passage, and means maintaining the second piston within the second portion of the second flow passage.

4. A heat pump system as defined by claim 1 wherein the valve linearly moves between the first and second positions.

5. A heat pump system as defined by claim 4 wherein:

the valve is located in the inlet; and as the valve moves between the first and second positions, the valve moves generally transverse to the direction of the refrigerant flow through the inlet.

6. A heat pump system as defined by claim 1 wherein the means responsive to the sensor includes:

an electric solenoid secure to the body; and a stem connecting the electric solenoid to the valve.

7. A heat pump system as defined by claim 1 wherein the compressor means includes:

a first stage compressor;

a second stage compressor;

means for sensing the heating load on the heat pump system;

means to activate the first stage compressor when the sensed heating load is above a predetermined level; and means to activate the second stage compressor.

8. An expansion device comprising:

a body defining an inlet, an outlet, a first flow passage for conducting fluid from the inlet to the outlet, and a second flow passage spaced from the first flow passage and also for conducting fluid from the inlet to the outlet;

a first piston means, mounted in the first flow passage to slide to a first position in the first flow passage when fluid flows from the inlet of the body through the first flow passage to the outlet of the body and to slide to a second position in the first flow passage when fluid flows from the outlet of the body through the first flow passage to the inlet of the body, for providing a first restriction to meter fluid flow through the first flow passage at a first flow rate when said first piston means is in its first position and for allowing substantially free fluid flow through the first flow passage when said first piston means is in its second position;

a second piston means, mounted in the second flow passage to slide to a first position in the second flow passage when fluid flows from the inlet of the body through the second flow passage to the outlet of the body and to slide to a second position in the second flow passage when fluid flows from the outlet of the body through the second flow passage to the inlet of the body, for providing a first restriction to meter fluid flow through the second flow passage at a second flow rate, which is less than the first flow rate provided by the first piston means, when said second piston means is in its first position and for allowing substantially free fluid flow through the second flow passage when said second piston means is in its second position;

a valve supported within the body for movement between a first valve position, closing the second flow passage to direct fluid through the first flow passage, and a second valve position, closing the first flow passage to direct fluid through the second flow passage; and means for moving the valve between the first and second valve positions.

9. An expansion device as defined by claim 8 wherein:

the body includes a first section defining the inlet, a first portion of the first flow passage, and a first portion of the second flow passage, a second section defining the outlet, a second portion of the first flow passage, and a second portion of the second flow passage; and means releasably connecting together the first and second sections; and disassembly of the first and second body sections exposes the first and second flow passages to provide access to the first and second portions.

* * * * *